United States Patent [19]

Stanley

[11] 4,239,224

[45] Dec. 16, 1980

[54] DRIVE AND INDEXING MECHANISM FOR A ROTATABLE DRUM CHANCE DEVICE

[75] Inventor: Louis Stanley, Beverly Hills, Australia

[73] Assignee: Galexie Manufacturing Pty. Ltd., Sydney, Australia

[21] Appl. No.: 889,592

[22] Filed: Mar. 23, 1978

[51] Int. Cl.[3] ..... A63F 5/04

[52] U.S. Cl. ..... 273/143 R

[58] Field of Search ..... 273/143 R, 143 A, 143 B, 273/143 C, 143 D, 143 E; 194/30, 41, 50, 81, 86, 89, DIG. 11, DIG. 12, DIG. 18; 74/96, 17.5

[56] References Cited

U.S. PATENT DOCUMENTS

| | | | |
|---|---|---|---|
| 1,805,837 | 5/1931 | Mills | 273/143 R |
| 2,010,487 | 8/1935 | Hochreim | 273/143 R |
| 2,152,599 | 3/1939 | Mills | 273/143 R |
| 2,812,182 | 11/1957 | Fiorino | 273/143 R |
| 2,932,976 | 4/1960 | Mihalek et al. | 273/143 R |
| 3,642,287 | 2/1972 | Lally et al. | 273/143 R |
| 3,975,963 | 8/1976 | Nicolaus | 74/17.5 |
| 4,037,845 | 7/1977 | Hooker | 273/143 R |
| 4,097,048 | 6/1978 | Poulsen | 273/143 R |

FOREIGN PATENT DOCUMENTS

| | | | |
|---|---|---|---|
| 14816 | of 1901 | United Kingdom | 194/30 |
| 1200172 | 7/1970 | United Kingdom | 194/30 |

*Primary Examiner*—William H. Grieb
*Assistant Examiner*—Arnold W. Kramer
*Attorney, Agent, or Firm*—Ladas & Parry

[57] ABSTRACT

A slot machine comprising an operator's lever, a drive mechanism and drive shaft, said drive mechanism being adapted to be engaged by said lever so as to be driven thereby to rotate said shaft in a first direction from a predetermined position and further adapted to be disengaged from said shaft and returned rapidly to said first position so that said shaft is rotated rapidly in the opposite direction to said first direction, an indexing mechanism having a pivoted lever, a first pin mounted on one end of a lever pivoted on said pivoted lever to engage and rotate an indexing wheel attached to a display wheel, a second pin on a lever pivotally mounted on the other end of said pivoted lever to engage and locate said indexing wheel in a predetermined position, and another lever fixed to said drive shaft to pivot said pivoted lever between the position of engagement of said second pin and the position of engagement of said first pin and to cause said first pin to rotate said indexing wheel when said shaft is rotated rapidly in said opposite direction and said second pin to index said wheel on the return of said pivoted lever to its home position.

23 Claims, 4 Drawing Figures

DRIVE AND INDEXING MECHANISM FOR A ROTATABLE DRUM CHANCE DEVICE

The present invention relates to games apparatus and more particularly but not exclusively to slot machines.

Due to the complexity of slot machines the cost of manufacture is considerable and accordingly there has been a need for a slot machine having a simplified operation to thus reduce cost. Additionally this complexity has resulted in increased mechanical and/or electrical failure coupled with wear due to the large number of moving parts.

Accordingly it is the object of the present invention to ameliorate the above disadvantages.

In a first general form the present invention is an indexing mechanism comprising:

a rotatable member mounted on a shaft for rotation about the axis of the shaft;

a first lever pivotally mounted intermediate its end;

first means mounted adjacent one end of said first lever for engagement with said rotatable member to locate said rotatable member at a particular angular position about said axis upon pivotal movement of said first lever to move said one end toward said rotatable member;

second means mounted adjacent the other end of said first lever for driving engagement with and to rotate said rotatable member upon pivotal movement of said first lever to move said other end toward said rotatable member, said second means including a second lever pivotally attached to said first lever adjacent said other end; and third means to move said first lever between the position of engagement of said first means with said rotatable member and the position of engagement of said second means with said rotatable member, and to pivotally move said second lever relative to said first lever when said second means is engaged with said rotatable member to rotate said rotatable member.

In a second general form the present invention is a drive mechanism comprising:

a lever mounted intermediate its ends on a shaft for pivotal movement about the axis of the shaft enabling movement of an end of the lever along a predetermined path;

a ratchet attached to said shaft;

a pawl to selectively engage said ratchet to prevent rotation of said lever in a non-driving direction;

a driven shaft; and driven means mounted on said driven shaft and engageable with an end portion of said lever so that upon rotation thereof in a driving direction rotation of said lever causes rotation of said driven shaft, said driven means including a stop member fixed to said driven shaft, a movable member rotatably mounted on said shaft and engageable with said stop member to limit rotation of said movable member between two angular positions relative to the stop member, said movable member being movable through a portion of said path while in one of said angular positions so as to be engaged by said end of the lever to be moved thereby to drive said shaft via said stop member, and wherein said driven means is adapted to engage said pawl when not being driven by said lever to allow rotation of said lever in a non-driving direction.

A preferred form of the present invention will now be described by way of example with reference to the accompanying drawings wherein.

Figure 1:
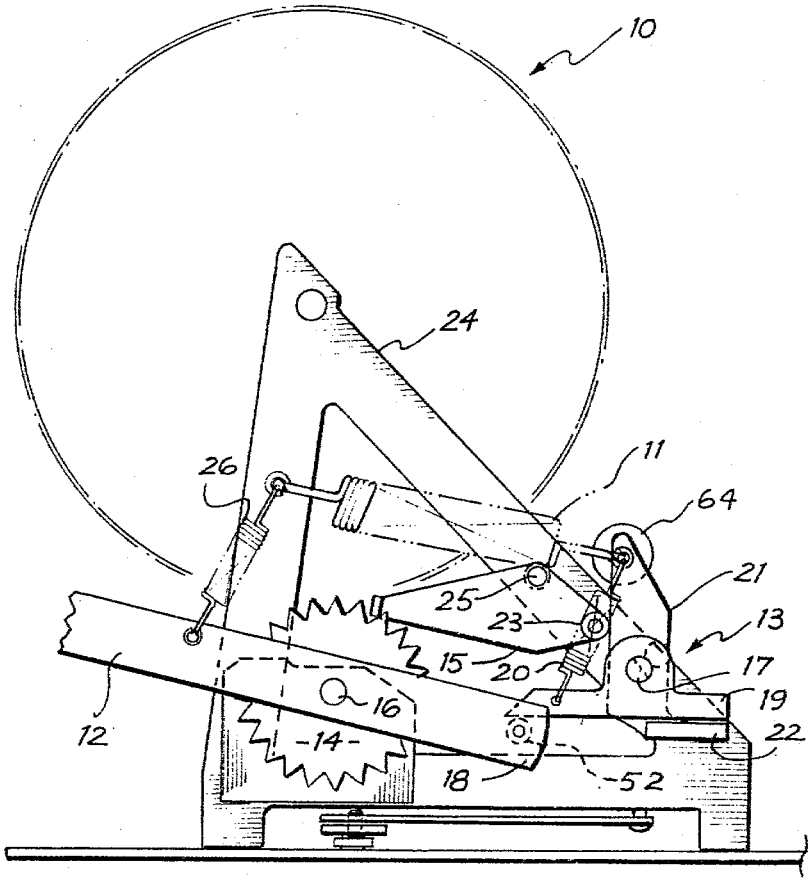
FIG. 1 is a schematic side elevation of a drive mechanism of a slot machine employing the present invention.
Figure 2:
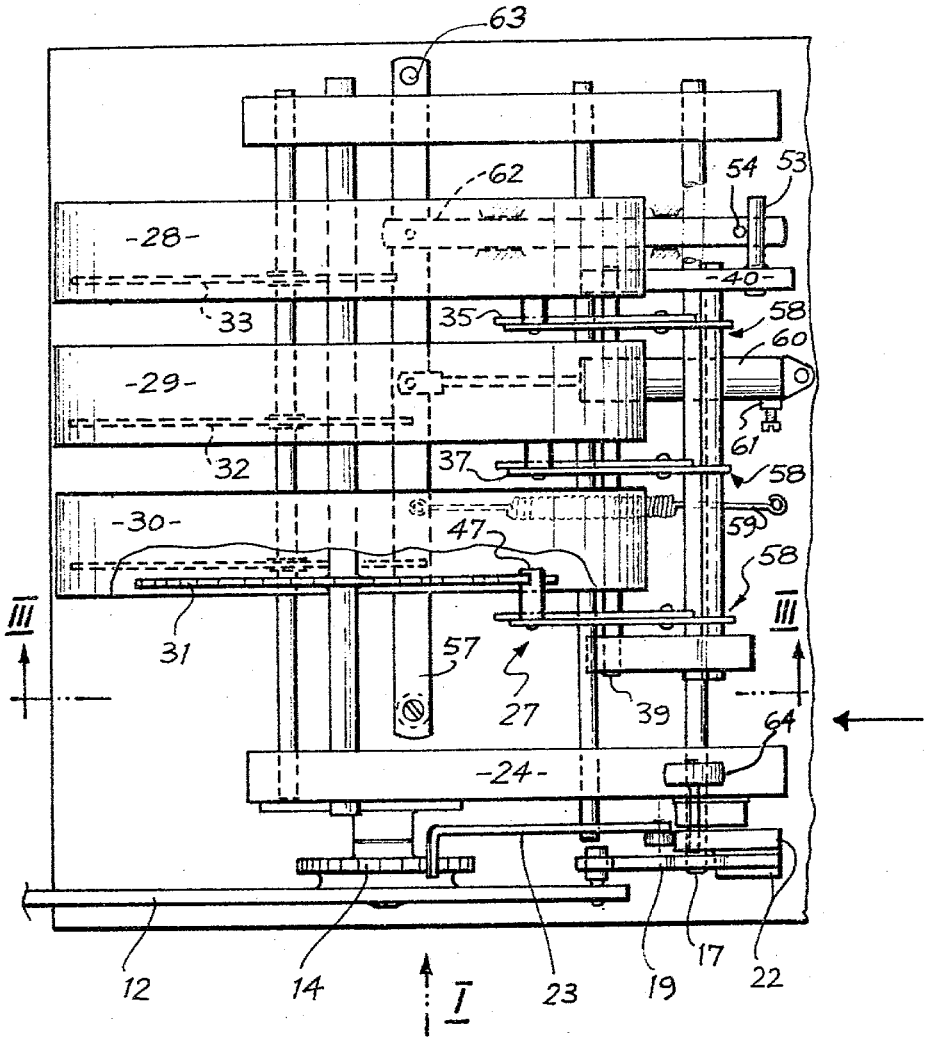
FIG. 2 is a schematic view of the machine.

The slot machine 10 of FIGS. 1 to 4 is of the manually operable type requiring manual effort to load the driving spring 11. The load is transferred from the lever 12 to the spring 11 via drive mechanism 13. The drive mechanism 13 comprises a ratchet 14 and pawl 15 which selectively engages the ratchet 14 to prevent rotation of the ratchet 14 and shaft 16 in a clockwise direction (non-driving direction) once operation of the machine has begun by pulling down on the end of the lever 12. The lever 12 is fixed to the shaft 16.

The shaft 17, which extends to and is drivingly connected to the indexing mechanism 27, is driven by the end 18 of the lever 12. The end 18 engages a movable member 19 rotatably mounted on shaft 17 and which is biased to the depicted position by spring 20. The driving load is transmitted from the member 19 to the shaft 17 via stop member 21 fixed to shaft 17. This stop member is provided with projection 22 which engages member 19 to limit clockwise rotation of member 19 relative to shaft 17. The stop member 21 is also adapted to engage an end 23 of the pawl 15 to move the pawl 15 from engagement with the ratchet 14 when the lever 12 is not in driving engagement with the movable member 19. The pawl 15 is rotatably mounted on the frame 24 of the machine by pin 25 and is biased under the influence of gravity to engage ratchet 14 once operation of the machine has begun.

In operation the lever 12 is rotated anti-clockwise to cause clockwise rotation of the members 19 and 21 through a predetermined angular path. Once the roller 52 engaging member 19 passes beyond the extremity thereof the assembly of shaft 17, member 19 and member 21 is released and under the load of spring 11 is caused to rotate anti-clockwise in a rapid movement. The spring 11 extends between the stop member 21 and frame 24.

The lever 12 is biased to the depicted position by spring 26. It should be appreciated that the end 18, and in particular roller 52, is allowed to pass the member 19 by anti-clockwise rotation of the member 19 relative to shaft 17 thus enabling the lever to return to the depicted position.

Figure 3:
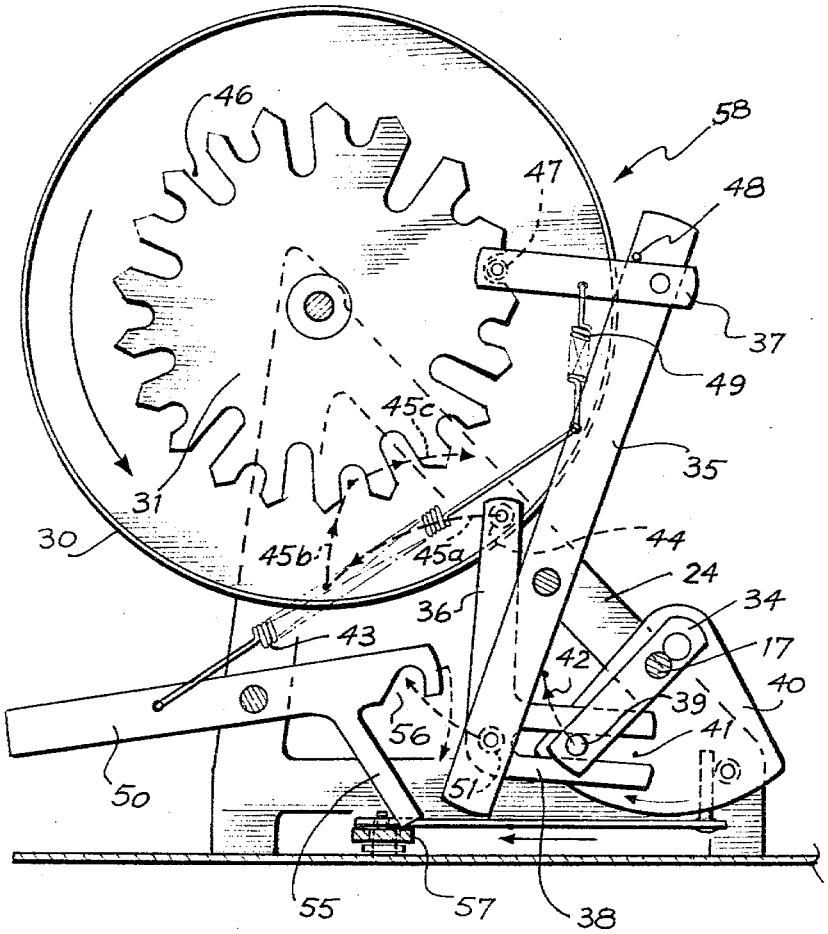
FIG. 3 is a schematic sectioned side elevation of the indexing mechanism of the slot machine taken on the line 3—3 of FIG. 2.
Figure 4:
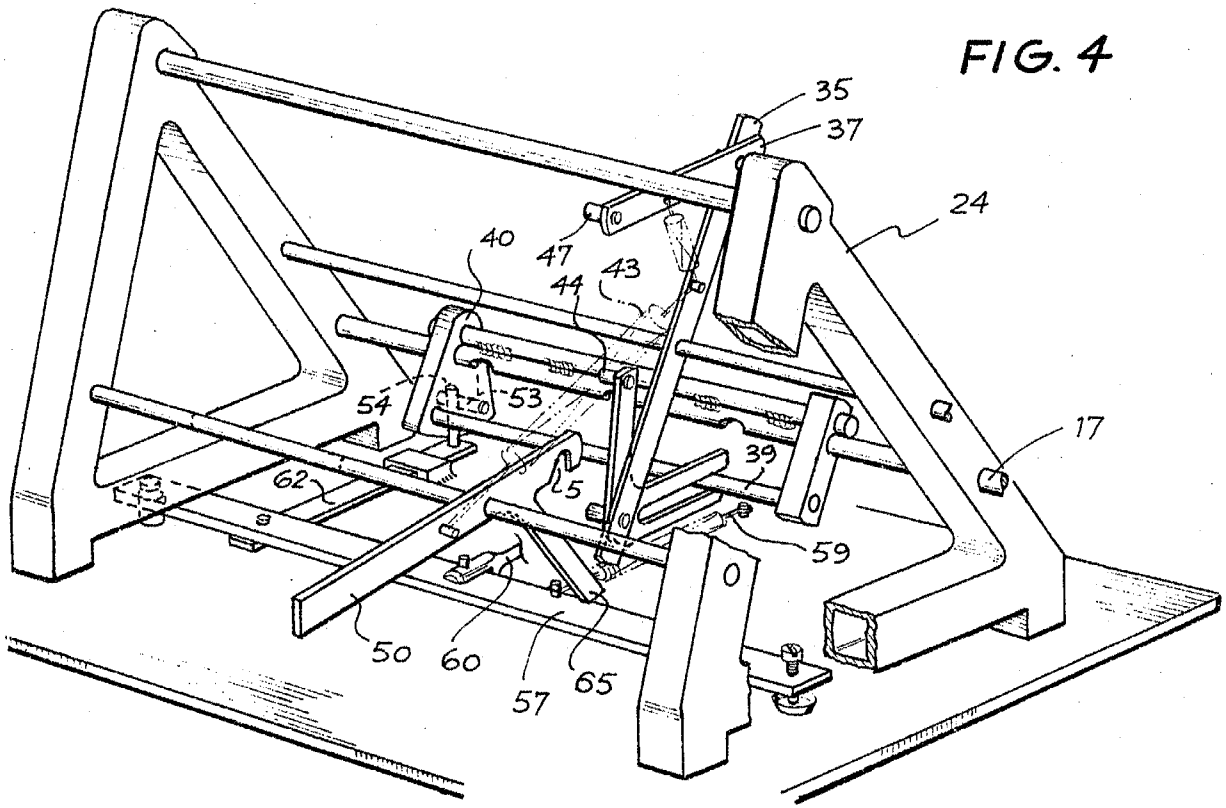
FIG. 4 is a schematic perspective view of the indexing mechanism of FIG. 3.

The indexing mechanism 27 best seen in FIGS. 3 and 4 is adapted to rotate display wheels 28, 29 and 30, via slotted disc members 31, 32 and 33 attached to display wheels 28, 29 and 30 respectively. The indexing mechanism 27 comprises three indexing units 58, one being for each display wheel. Each unit 58 comprises a system of levers 35, 36 and 37 which are driven via shaft 17 extending from the drive mechanism 13. Accordingly the indexing mechanism 27 will be explained with reference to one of the indexing units 58.

First levers 34 and 40 are attached to the shaft 17 and accordingly, when driven by the lever 12, rotate in a clockwise direction. The levers 34 and 40 are further joined by rod 39. Lever 36, having slotted portion 38, is caused to rotate in an anti-clockwise direction by the movement of rod 39 along the slot 41 until rod 39 engages lever 35 as indicated by the dashed path 42 which represents the initial path of travel of the pin 39. Upon further rotation of the levers 34 and 40 the lever 35 is caused to rotate clockwise taking with it via pin 51 the lever 36 which continues to rotate anti-clockwise relative to the lever 35. The result being that the roller 44 located at an extremity of the lever 36 follows the dashed path 45. The two first portions 45(*a*) and (*b*) of the path 45 result from the lever 12 driving the shaft 17 to locate the roller 44 in one of the slots 46. The last portion 45(*c*) depicts the path of movement of the roller 44 due to the rapid anti-clockwise movement of the shaft 17 under action of the driving spring 11. Prior to this rapid anti-clockwise movement of shaft 17 the pin 51 is engaged within the slot 56 of the lever 50 so that the lever 35 remains in a displaced position once shaft 17 begins the rapid anti-clockwise movement. The result being that rod 39 moves back along the slot 41 thus rotating lever 36 clockwise rapidly. The movement of the roller 44 along the path 45(*c*) causes rotation of its corresponding disc member 31. The lever 37 has a roller 47 which engages any one of the plurality of slots 46 to locate its corresponding display wheel 30 in a predetermined position. The roller 47 is withdrawn from the engaged one of the slots 46 by the clockwise pivoting of the lever 35 resulting from the engagement of rod 39 with lever 35 as described above. The lever 37 is biased to the depicted position, defined by stop 48, by spring 49.

Timing of the indexing mechanism 27 is effected by the engagement of the slot 56 with the pin 51 to hold the lever 35 in a position such that the roller 47 is not engaged within any one of the slots 46. The lever 35 is released by the anti-clockwise rotation of the lever 50 to release the pin 51 by engagement of the bar 57 with projection 55 of lever 50.

The bar 57 is first rotated about pin 63 in a clockwise direction by the rotation of lever 40 pushing bar 62, via pins 53 and 54, until the downwardly projection portion 55 of each lever 50 passes beyond the edge of the bar 57 thus allowing clockwise rotation of the lever 50. Toward the end of the anti-clockwise movement of bar 57 the lever 50 is located in readiness to receive pin 51 in the slot 56. Once the pictorial wheels 28, 29 and 30 have been rotated the bar 57 is allowed to rotate anti-clockwise since the pin 53 has been moved away from pin 54. The bar 57 is rotated anti-clockwise by spring 59. The time delay between the engagement of bar 57 with projection 55 of each of the indexing units 58 is governed by the release of air from air cylinder 60. Additionally the extremity of the projection 55 of each indexing unit 58 is not in alignment with the others and accordingly the bar 57 engages each projection 55 after a different time interval to thereby release a corresponding lever 35 at a corresponding time interval to allow staggered engagement of a corresponding lever 37 with a respective one of the disc members 31, 32 or 33. The lever 50 is biased to a position of engagement with the pin 51 by spring 43.

The rapid anti-clockwise movement of shaft 17 is halted by the engagement of abutment means 64 engaging frame 24. The time delay between the stopping of the display wheels 28, 29 and 30 may be varied by the operation of variable orifice 61 of cylinder 60.

What I claim is:

1. A drive mechanism comprising:

a drive lever mounted intermediate its ends on a shaft for pivotal movement about the axis of the shaft enabling movement of an end of the lever in a driving direction along a predetermined path;

a ratchet attached to said lever;

a pawl to selectively engage said ratchet to prevent rotation of said lever in a non-driving direction;

a driven shaft; and driven means mounted on said driven shaft and engageable with said end of said lever so that upon rotation thereof in said driving direction rotation of said lever causes rotation of said driven shaft, said driven means including a stop member fixed to said driven shaft, a movable member rotatably mounted on said shaft and engageable with said stop member to limit rotation of said movable member about said shaft between a driven first angular position and a non-driven second angular position, said movable member being rotatable by said end of the lever to be moved thereby to drive said shaft in a driven direction via said stop member, and wherein said driven means is adapted to engage and move said pawl from engagement with said ratchet when said driven means is not being driven by said lever to allow rotation of said lever in said non-driving direction.

2. The drive mechanism of claim 1 further including spring means biasing said driven shaft to rotate in a non-driven direction so that when said end of said lever becomes disengaged from said movable member said shaft is caused to rotate.

3. The drive mechanism of claim 1 or 2 wherein said end of said lever is movable past said movable member in a non-driving direction by reverse rotation of said movable member to said non-driven angular position.

4. A drive mechanism comprising: a drive lever mounted intermediate its ends on a shaft for pivotal movement about the axis of the shaft enabling movement on the end of the lever in a driving direction along a predetermined path; a driven shaft; driven means mounted on said driven shaft and engageable with said end of said lever so that upon rotation thereof in said driving direction rotation of said lever causes rotation of said driven shaft, said driven means including a stop member fixed to said driven shaft, a movable member rotatably mounted on said shaft and engageable with said stop member to limit rotation of said movable member about said shaft between a driven first angular position and a non-driven second angular position, said movable member being rotatable by said end of the lever to be moved thereby to drive said shaft in a driven direction by said stop member.

5. The drive mechanism of claim 4 including lever control means adapted to selectively prevent pivoting of said drive lever in a non-driving direction once movement of said lever has been initiated.

6. The drive mechanism of claim 5 wherein said lever control means comprises a ratchet attached to said lever for rotation about the axis of said shaft and a pawl to engage said ratchet to selectively prevent rotation of said lever in a non-driving direction.

7. The drive mechanism of claim 6 wherein said pawl is adapted to be engaged by said driven means to move said pawl from engagement with said ratchet when said end of said lever is not in driving engagement with said movable member to allow rotation of said lever in said non-driving direction.

8. The drive mechanism of claim 7 wherein said pawl is selectively engaged by said stop member so as to be moved thereby to a position for non-engagement with said ratchet.

9. The drive mechanism of claim 8 further including spring means biasing said driven shaft to rotate in a non-driven direction so that when said end of said lever becomes disengaged from said movable member said shaft is caused to rotate rapidly in a non-driven direction.

10. The drive mechanism of claim 9 wherein said end of said lever is movable past said movable member in a non-driving direction by reverse rotation of said movable member to said non-driven angular position.

11. The drive mechanism of claim 4 or 10 wherein said movable member is biased to said first angular position by spring means.

12. A games apparatus having a drive mechanism including a drive lever mounted intermediate its ends on a shaft for pivotal movement about the axis of the shaft enabling movement of an end of the lever in a driving direction along a predetermined path; a driven shaft; driving means mounted on said driven shaft and engageable with said end of said lever so that upon rotation thereof in said driving direction rotation of said lever causes rotation of said driven shaft, said driven means including a stop member fixed to said driven shaft, a movable member rotatably mounted on said shaft and engageable with said stop member to limit rotation of said movable member about said shaft between a driven first angular position and a non-driven second angular position, said movable member being engaged by said end of the lever to be rotated thereby to drive said shaft in a driven direction by said stop member; an indexing mechanism having a rotatable indexing member mounted on a shaft for rotation about the axis of the shaft; a first indexing lever pivotally mounted intermediate its end; first means mounted adjacent one end of said first indexing lever for engagement with said rotatable indexing member to locate said rotatable indexing member at any one of particular angular positions about said axis; second means mounted adjacent the other end of said first indexing lever for driving engagement with said rotatable indexing member to rotate it upon pivotal movement of said first indexing lever to move said other end toward said rotatable indexing member, said second means including a second indexing lever pivotally attached to said first indexing lever adjacent said other end; and third means operatively coupled to said driven shaft so as to be moved thereby to move said first indexing lever between the position of engagement of said first means with said rotatable indexing member and the position of engagement of said second means with said rotatable indexing member, and to pivotally move said second indexing lever relative to said first indexing lever when second means is engaged with said rotatable indexing member to rotate said rotatable member.

13. The games apparatus of claim 12 wherein said third means includes a third indexing lever fixed to said driven shaft, a slidable coupling drivingly connecting said third indexing lever with said second indexing lever to rotate the first and second indexing levers to a position such that an extremity of said second indexing lever is moved into engagement with said rotatable indexing member upon the rotation of said driven shaft in said driven direction.

14. The game appara of claim A frher including forth means o hold said fir indexing lever in he posiion of engagement of said second means ith said indeing member member has a peripheral surface with a plurality of radially inwardly extending slots and said first and second means each include a pin to engage said slots.

15. The games apparatus of claim 14 wherein said path of movement of said extremity results from rotation of said driven shaft in the opposite direction to said first direction.

16. The games apparatus of claim 15 wherein the indexing member has a peripheral surface with a plurality of radially inwardly extending slots and said first and second means each include a pin to engage said slots.

17. The games apparatus of claim 16 further including fourth means to temporarily hold said first indexing lever in the position of engagement of said second means so that the pin of said second indexing lever is held in engagement with one of said slots over a portion of a path of its travel.

18. The games apparatus of claim 17 wherein said fourth means includes a pivotally mounted fourth indexing lever with a slot adjacent one end, and a pin extending from said first indexing lever and engageable by the slot of said fourth indexing lever to temporarily hold said first indexing lever.

19. The games apparatus of claim 17 further including spring means biasing said first indexing lever to a position of engagement of said first means.

20. The games apparatus of claim 19 further including fifth means to move said fourth indexing lever to release the pin of said first indexing lever so that said first indexing lever pivots under the influence of said spring means.

21. The games apparatus of claim 20 wherein said fifth means includes timing means which releases said fourth indexing lever after a different time period.

22. The games apparatus of claim 21 wherein said timing means comprises a pivotally mounted bar which engages the fourth indexing lever, a spring biasing said bar to a position of engagement with the fourth indexing lever, and sixth means clamping the movement of said bar toward said fourth indexing lever.

23. The games apparatus of claim 22 wherein said sixth means is an air cylinder attached to said bar, and said air cylinder has a variable orifice to regulate the rate of flow of air from within the cylinder.

* * * * *